US006253521B1

(12) United States Patent
Gavin et al.

(10) Patent No.: US 6,253,521 B1
(45) Date of Patent: Jul. 3, 2001

(54) STEEL-FRAMED BUILDING CONSTRUCTION

(75) Inventors: Peter Geoffrey Gavin; Peter Robert Brennan; Thomas William Ellis, all of Napier (NZ)

(73) Assignee: Scottsdale Building Systems Limited, Napier (NZ)

( * ) Notice: Subject to any disclaimer, the term of this patent is extended or adjusted under 35 U.S.C. 154(b) by 0 days.

(21) Appl. No.: 09/251,375

(22) Filed: Feb. 17, 1999

(30) Foreign Application Priority Data

Oct. 21, 1998 (NZ) ..... 332445

(51) Int. Cl.[7] ..... E04B 1/32; E04C 3/02

(52) U.S. Cl. ..... 52/639; 52/79.1; 52/91.1; 52/481.1; 52/653.1; 52/745.13; 52/745.2

(58) Field of Search ..... 52/91.1, 479, 79.1, 52/639, 653.1, 745.13, 745.2, 481.1

(56) References Cited

U.S. PATENT DOCUMENTS

| | | | | |
|---|---|---|---|---|
| 1,747,313 | * | 2/1930 | Miss | 52/91.1 X |
| 1,925,769 | * | 9/1933 | McAvoy et al. | 52/91.1 X |
| 2,329,041 | * | 9/1943 | Ford | 52/639 X |
| 4,858,398 | * | 8/1989 | Ricchini | 52/94 X |
| 5,526,628 | | 6/1996 | Knudson . | |
| 5,651,230 | | 7/1997 | Knudson . | |

FOREIGN PATENT DOCUMENTS

| | | |
|---|---|---|
| 52665 | 12/1993 | (AU) . |
| 52666 | 12/1993 | (AU) . |
| WO 96/35022 | 11/1996 | (WO) . |

* cited by examiner

*Primary Examiner*—Christopher T. Kent
(74) *Attorney, Agent, or Firm*—Workman, Nydegger & Seeley

(57) ABSTRACT

A steel framed building construction (50) includes external wall frames (52, 54) and internal wall frames (57, 58) which support one or more planar ceiling frames (56). A roof structure includes one or more substantially planar roof frames (76, 78) extending substantially parallel to associated roof surfaces which the roof frames support. The roof structure further includes support means (70, 74) extending between the roof frames (76, 78) and the ceiling frames (56) to transfer the weight of the roof structure to the ceiling frames (56) to thereby distribute the combined weight of the roof structure and the ceiling frames (56) and the support means (70, 74) through the external and internal wall frames (52, 54, 57, 58). A new roof structure is also claimed. A construction methodology whereby the wall frames, the roof frames and the roof support frames are all constructed from the same steel section is also claimed. A structural frame constructed from a number of intersecting structural members of a U-section with inward strengthening folds (14) is also claimed. The folds are formed back to the plane of the associated arm (12) at each junction between intersecting structural members (10). A method of slab preparation wherein the ceiling frame (56) is used as a template is also claimed. A method of constructing a roof structure includes moving preassembled planar roof frames into position lying substantially planar to the plane of an associated intended roof surface to thereby support the associated roof surface in the finished roof. The roof frames (76, 78) are supported in their respective inclined positions.

33 Claims, 12 Drawing Sheets

STEEL-FRAMED BUILDING CONSTRUCTION

TECHNICAL FIELD

The present invention relates to steel-framed building construction. In particular, although not exclusively, the invention relates to a new form of building construction using steel structural members made from light gauge steel sheet. The invention also relates to a method of roof construction wherein entire roof panels are lifted into position to form the roof structure. The invention also relates to a new type of structural frame adapted to be constructed from light gauge steel section. Further, the invention also relates to a method of slab preparation. While the invention will be illustrated and described herein in terms of a domestic dwelling, it will be understood that the invention is not limited to the construction of domestic dwellings and will have application in commercial and industrial building construction.

BACKGROUND ART

Steel frames have been used previously in building construction but it is understood that their use has been limited to steel frames constructed from thick gauge steel section. By "thick gauge", steel section of 1.2 mm in thickness is intended. It is thought that building construction using steel frames has been limited to thick gauge steel section because the design of such structures has been limited by conventional approaches to building. In conventional building design, the roof structure is formed from a series of triangular roof trusses (see FIG. 3). The combined load of the roofing material and the roof trusses is transferred through the outer edges of the trusses to the top plate of the external walls of the building. The trusses thereby transfer point loads to the top plate. Conventional steel frame buildings have therefore been constructed using thick gauge steel section to withstand these point loads. Considerable difficulties arise in using thick gauge steel section for building frames. The section is difficult to cut and form. Often, the heat generated by cutting destroys the galvanised coating on the steel section. An added difficulty arises in joining the structural members once formed to make up a building frame. Owing to the rigid nature of the thick gauge section, the structural members cannot be easily deformed to fit one within another and must undergo crimping or other special forming operations to ensure that the structural members can matingly engage.

A difficulty with conventional building structures is that assembly of the various elements requires skilled labour. In timber structures, the roof trusses are often constructed by assembling the timber pieces in situ because the heavy timber would be difficult to manage and lift an assembled or partially assembled form. The difficulty of assembling roof trusses in situ is that all of the roof trusses must be assembled to define a plane for the intended roof surface and thus the upper edges of all of the roof trusses must align. It will therefore be appreciated that roof construction requires considerably skilled labour.

Additionally, the preparation of a slab is another area of difficulty requiring careful marking. Otherwise, a slab can be too large or too small for the intended building. A slab which is too large may require removal of portions of the slab whereas a slab which is too small may require further form work to be erected to enable other portion of the slab to be poured. These additional steps will create delays in the construction process.

It is therefore an object of the present invention to provide a new building construction and a new methodology of construction which overcomes or at least ameliorates the above mentioned disadvantages.

SUMMARY OF THE INVENTION

In accordance with a first aspect of the present invention, there is provided a method of constructing a roof structure for a building, the roof structure being of the type intended to support two or more inclined roof surfaces, the method including: moving pre-assembled planar roof frames into respective positions, each roof frame being moved to a position lying substantially parallel to the plane of an associated intended roof surface to thereby support the associated roof surface in the finished roof, supporting each of the roof frames in its inclined position.

Preferably, a single inclined roof frame is provided to support each inclined roof surface in the finished roof, the roof frame being moved into position as a single unit. Each roof frame may be assembled on site prior to moving into position. In a most preferred form of the invention, each roof frame is assembled from light-weight steel structural members by workers operating at ground level and the roof frame lifted manually into position. Alternatively, a crane might be used to lift the structural members. By "light gauge" or "light-weight", steel section of between 0.4 mm and 0.7 mm, and preferably 0.55 mm is understood. However the invention is not limited to steel and other metals such as aluminium may be appropriate.

It will be understood that while the roof frames are described as "planar", the invention defined above is not limited to having the structural members all lying within the same plane. "Planar" includes constructions with the structural members not lying within the same plane so long as the general extent of the frames is substantially 2-dimensional. This meaning is intended to apply to all frame types referred to as "planar".

Advantageously, each of the roof frames comprise a number of structural members and the method of the invention further includes: constructing all of the frames from structural members of the same steel section the same steel section being used for the whole of each frame; and assembling all of the structural members of each frame to lie in the same plane.

Preferably, the roof frames are supported by a support means. Preferably the support means comprises a central upright planar frame disposed underneath the intersection of two inclined roof surfaces. Suitably, the roof frame(s) are also supported at their outer edges by the walls of the building or a top-plate of a ceiling frame. Further, the roof frame(s) associated with each inclined roof surface may also be supported by an intermediate planar upright support frame extending parallel to the central planar frame. In a preferred form of the invention, two inclined roof frames meet at a ridge and the central support frame extends substantially along the length of the ridge.

Preferably, the support means and the outer edges of the inclined roof frame(s) are supported by a planar ceiling structure extending substantially the length and breadth of the building. The planar ceiling structure is preferably assembled from a number of pre-assembled planar ceiling frames lifted into position.

In a preferred form of the invention, the roof structure is of the type intended to support one or more inclined hip surfaces. The method of the invention further includes: lifting one or more pre-assembled hip roof frames into position lying substantially parallel to the plane of an associated intended hip surface to thereby support the associated hip surface in the finished roof; supporting the hip roof frame(s) from adjacent edges of the adjacent inclined roof frames. However, it will be appreciated that the invention is not limited to a hip type roof and may have application to other roof structures such as gable-ended roofs or pyramid type roofs.

In accordance with a second aspect of the present invention, there is provided a steel frame building construction including:

external wall frames and internal wall frames;

one or more substantially planar ceiling frames supported by the external wall frames and the internal wall frames;

a roof structure including one or more inclined substantially planar roof frames extending substantially parallel to and supporting respective roof surfaces;

support means extending between the roof frame(s) and the ceiling frame(s) to transfer the weight of the roof structure to the ceiling frame(s) to thereby distribute the combined weight of the roof structure and the ceiling frame(s) and the support means through the external and internal wall frames, wherein each of the wall frames, ceiling frame(s) and roof frame(s) are constructed of steel structural members.

Preferably the steel structural members are formed from steel sheet of approximately 0.55 mm in thickness. However, the thickness might range between 0.4 mm and 0.7 mm in thickness. In a preferred form of the invention all of the structural members of all of the frames are of the same steel section.

Advantageously for each frame, all of the steel structural members lie in the same plane thereby defining a number of junctions within the plane with one structural member received within another. Most preferably, the structural members each have a web and two arms completing a channel section, with inward strengthening folds at the outer edge of each arm, the other structural member at each junction having its strengthening folds being formed back to the plane of the associated arm in the region of the junctions. In a most preferred form of the invention the ceiling frames have long and short transverse structural members, the long members arranged in a series of spaced back-to-back pairs, and the short transverse structural members being inserted between spaced pairs of long structural members.

Preferably, the ceiling frames are constructed from lightweight steel. Each of the ceiling frames may comprise a number of structural elements, the method further including using steel section to make all of the structural elements of all of the ceiling frames and assembling all the structural elements to lie in the same plane.

The building roof structure may have two inclined roof surfaces meeting at a ridge which extends in the lengthwise direction of the roof structure. Preferably, the two inclined roof surfaces are supported by respective inclined planar roof frames and the roof frames are supported by at least three upright planar support frames extending in the lengthwise direction of the roof.

Advantageously, the three upright planar support frames include a central support frame extending substantially the length of the ridge. Desirably, each of the upright planar support frames include diagonal braces.

In accordance with a third aspect of the present invention, there is provided a building construction including wall frames, a roof structure having a number of frames and a roof support structure having a number of frames wherein each of the frames include structural members, the structural members being of the same steel section for the whole of each frame and for all of the frames.

The structural members may each have a web and two arms completing a U-section, with inward strengthening folds at the outer edge of each arm. Preferably, the structural members of each frame are assembled in the same plane thereby defining a number of junctions within the plane with one structural member received within another. At each junction, the other structural member has its strengthening folds being formed back at least to the plane of the associated arm in the region of the junction.

In accordance with a fourth aspect of the present invention, there is provided a method of constructing a building including: constructing wall frames; constructing a roof support structure from a number of frames; constructing a roof structure from a number of frames; constructing each of the frames from structural members, the structural members being of the same steel section for the whole of each frame and for all of the frames.

Preferably, the method set out above further includes assembling all of the structural members in the same plane to thereby define a number of junctions and fitting the structural members one within another at the junctions. Desirably, the structural members each have a web and two arms completing a U-section, with strengthening folds at the outer edge of each arm, the method further including for each junction, forming back the strengthening folds on the other structural member to at least the plane of the associated arm in the region of the junction.

In accordance with a fifth aspect of the present invention, there is provided a structural frame comprised of a number of intersecting structural members of the same cross-section wherein the structural members each have a web and two arms completing a U-section, with inward strengthening folds at the outer edge of each arm, one structural member being fitted within another at the intersections, the other structural member having its strengthening folds being formed back to at least the plane of the associated arm in the region of the intersections.

In accordance with a sixth aspect of the present invention, there is provided a method of constructing a structural frame from a number of structural members of the same cross-section wherein the structural members each have a web and two arms completing a U-section, with inward strengthening folds at the outer edge of each arm, the method further including fitting the structural members together to define a number of intersections therebetween, with the intersections having one structural member fitted within another, the method including, in the region of certain of the intersections, forming back the strengthening folds on the other structural member to at least the plane of the associated arm.

In accordance with a seventh aspect of the present invention, there is provided a method of slab preparation for a building of the type including one or more planar ceiling frame(s), the method including the steps of:

positioning the pre-assembled planar ceiling frame(s) on the ground in the intended location of the building; and constructing the formwork for the slab around the ceiling frame(s).

Preferably the method includes the further steps prior to constructing the formwork:

marking the outer edge of the ceiling frame(s) on the ground;

removing the ceiling frame(s);

digging a trench and pouring concrete in the trench;

returning the ceiling frames to the initial position.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

In order that the invention may be more fully understood, one embodiment will now be described by way of example with reference to the drawings in which.

DESCRIPTION OF THE PREFERRED EMBODIMENTS

Figure 1A:
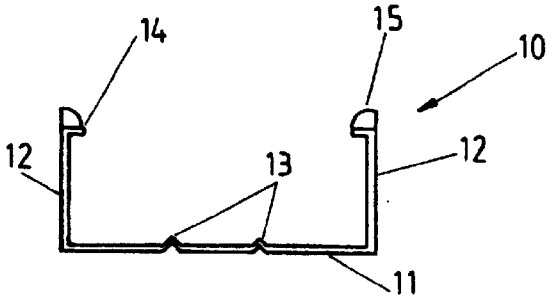
FIG. 1*a* is a cross section through a steel structural member according to a preferred embodiment of the present invention.

FIG. 1*a* illustrates the structural member 10 which is used to make up all of the frames illustrated in FIGS. 4 to 11. The supply and handling of a single steel section for all of the structural members is simpler than using varied structural sections. An additional advantage of using the same steel section for all of the structural members is that the structural members can all be produced on site by the use of a single portable roll forming machine. This will further simplify the handling of material for the structural members since the structural members can be produced on site from coils of steel sheet. This eliminates the need to bundle and carry length of steel section. Moreover, the production of the structural members on site eliminates the need to sort the structural members and avoids any confusion as to the precise location of each structural member.

Figure 1B:
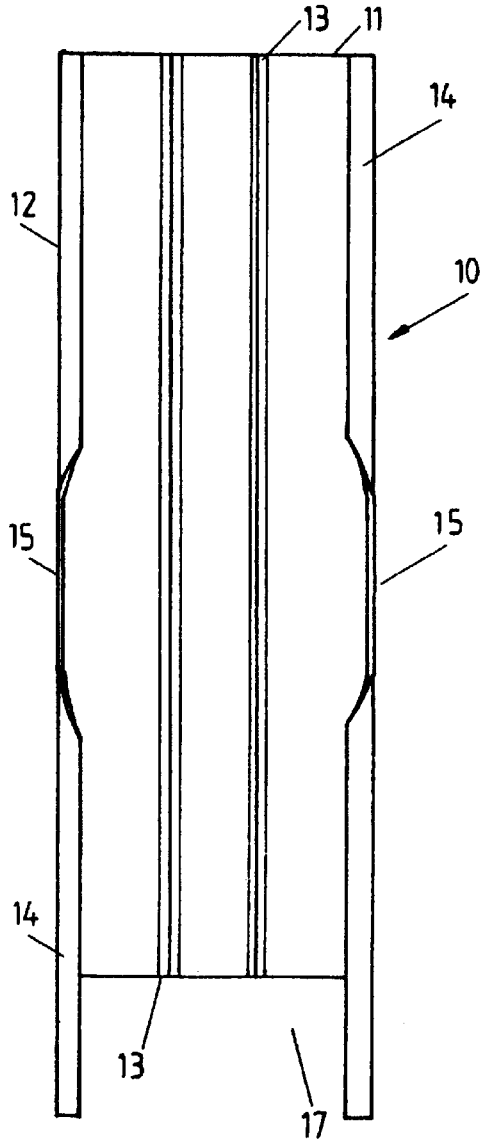
FIG. 1*b* is a plan view of the structural member illustrated in FIG. 1*a;*
Figure 1C:
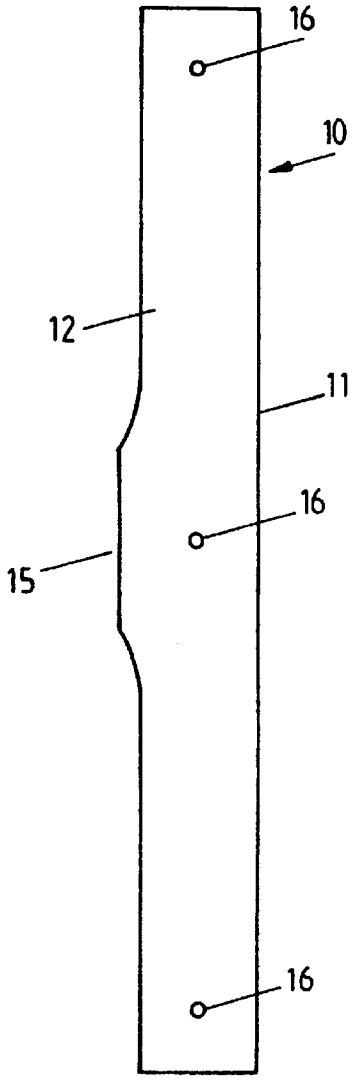
FIG. 1*c* is a side view of the structural member illustrated in FIG. 1*a;*

The structural member 10 (illustrated in FIGS. 1*a* to 1*c*) is a channel having a web 11 and arms 12 in a squared U-section. The member is not necessarily realistic in its arrangement of particular features but serves to demonstrate those features in a compact fashion. In the member 10, web 11 is seen to have a pair of strengthening ribs 13 which are spaced from each other and extend in the lengthwise direction of the web 11. The arms 12 each have a strengthening fold in the form of a lip 14 turned inwards to the channel. Flattened edge portions 15 of the strengthening folds 14 are formed back to the plane of the arms 12. These flattened edged portions 15 are disposed on opposite sides of the member 10 to enable another structural member to be accommodated within the channel to thereby form a joint between the two members. A joint of this type has been illustrated in FIG. 2*c* where the structural member 25 is inserted into the channel of structural member 26. One of the flattened edge portions 15 of the structural member 26 can be viewed in FIG. 2*c*. Joints of this type are required when junctions between two intersecting members have one member 25 to be inserted within another member 26 whereby the other member 26 extending through the intersection has the open side of the channel facing the member 25.

Figure 2A:
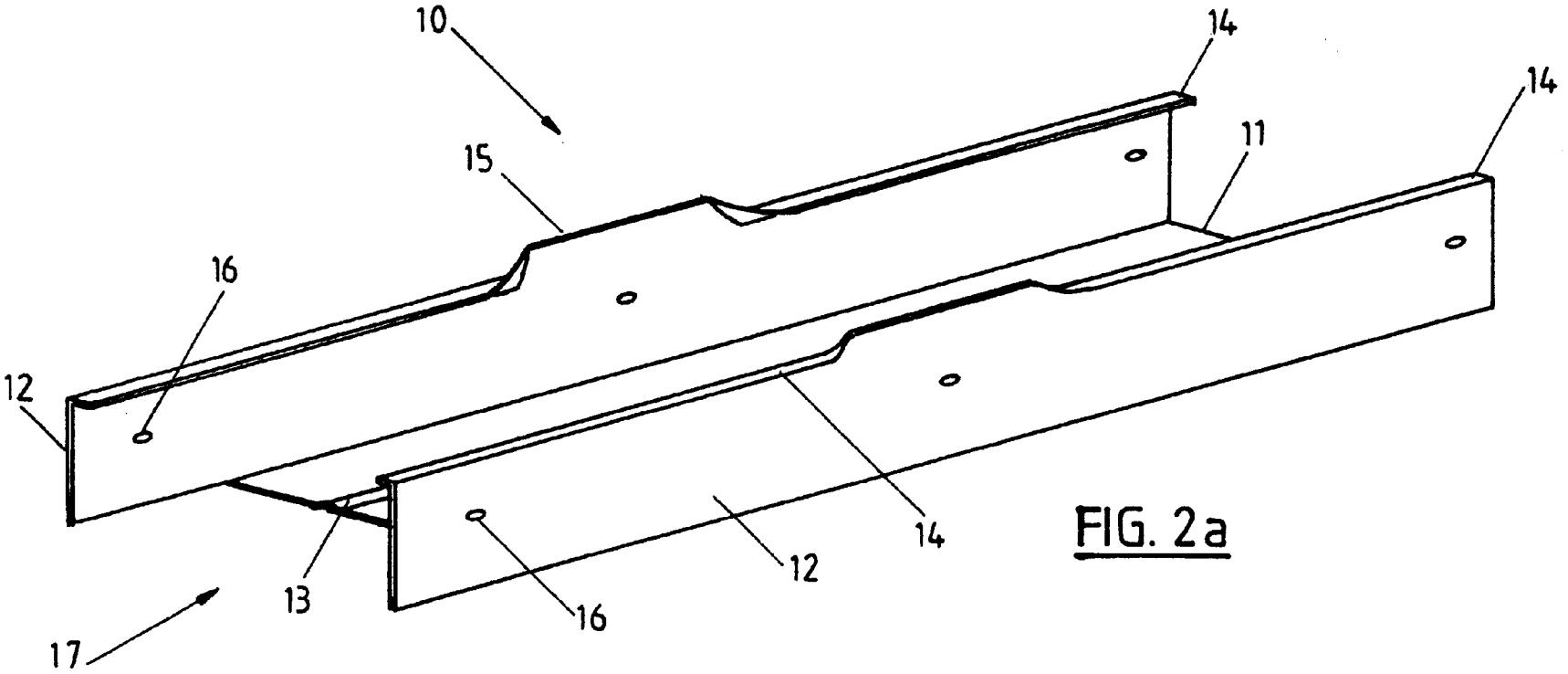
FIG. 2*a* is a perspective view of the structural member illustrated in FIG. 1*a;*
Figure 2B:
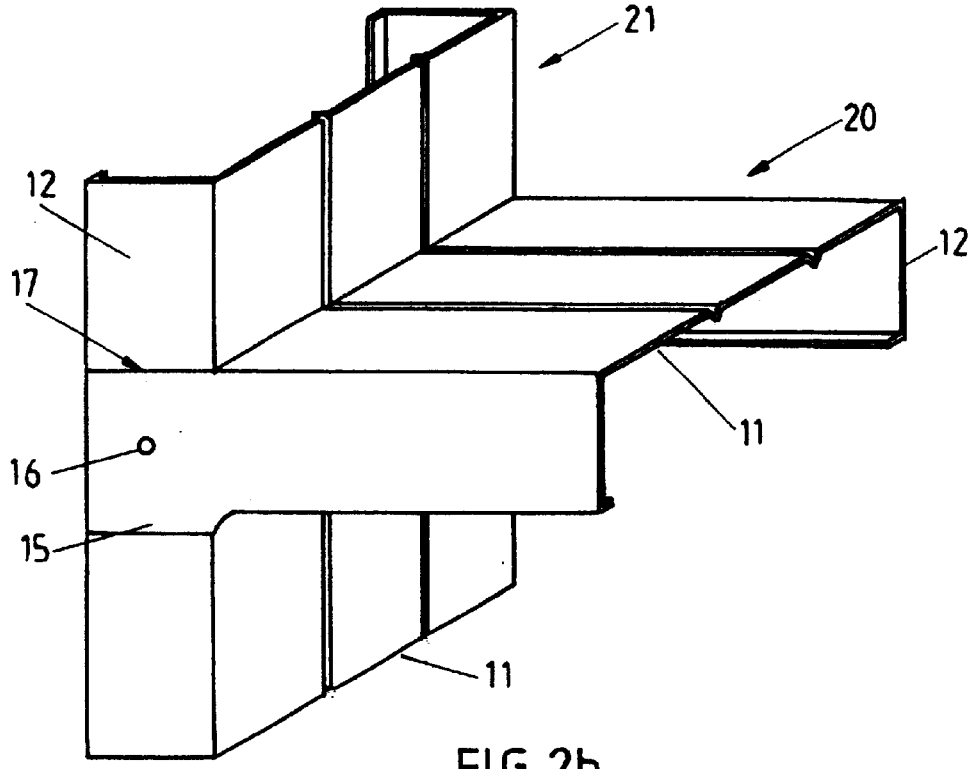
FIG. 2*b* is a first type of joint between two structural members of the type illustrated in FIG. 1*a;*
Figure 2C:
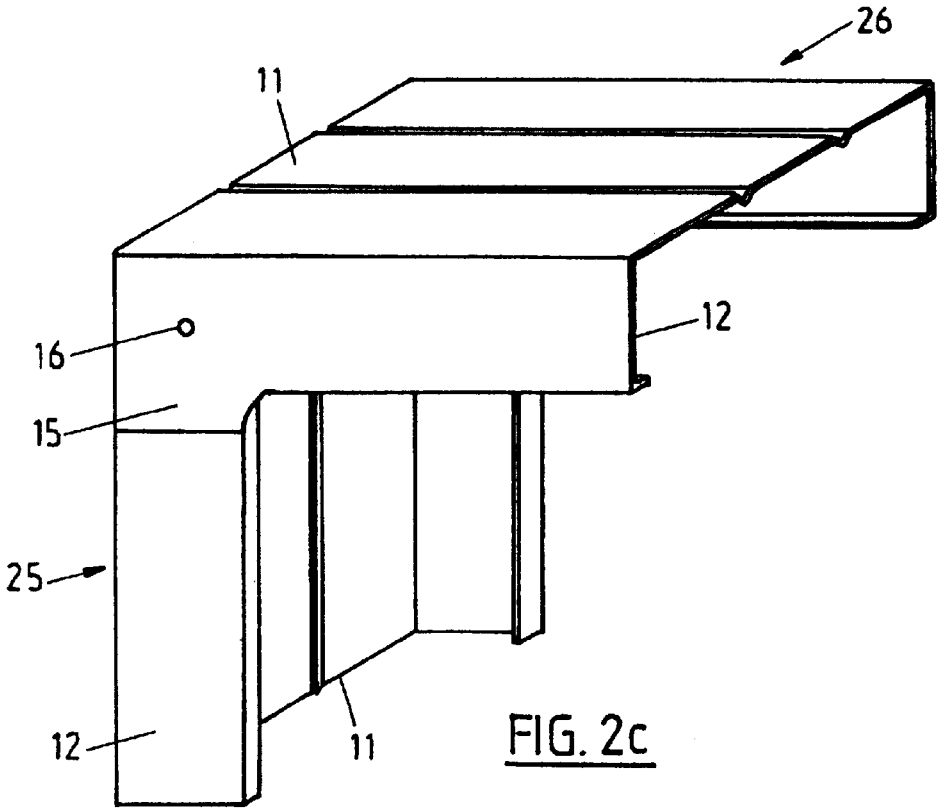
FIG. 2*c* is a second type of joint between two structural members of the type illustrated in FIG. 1*a;*
Figure 3:
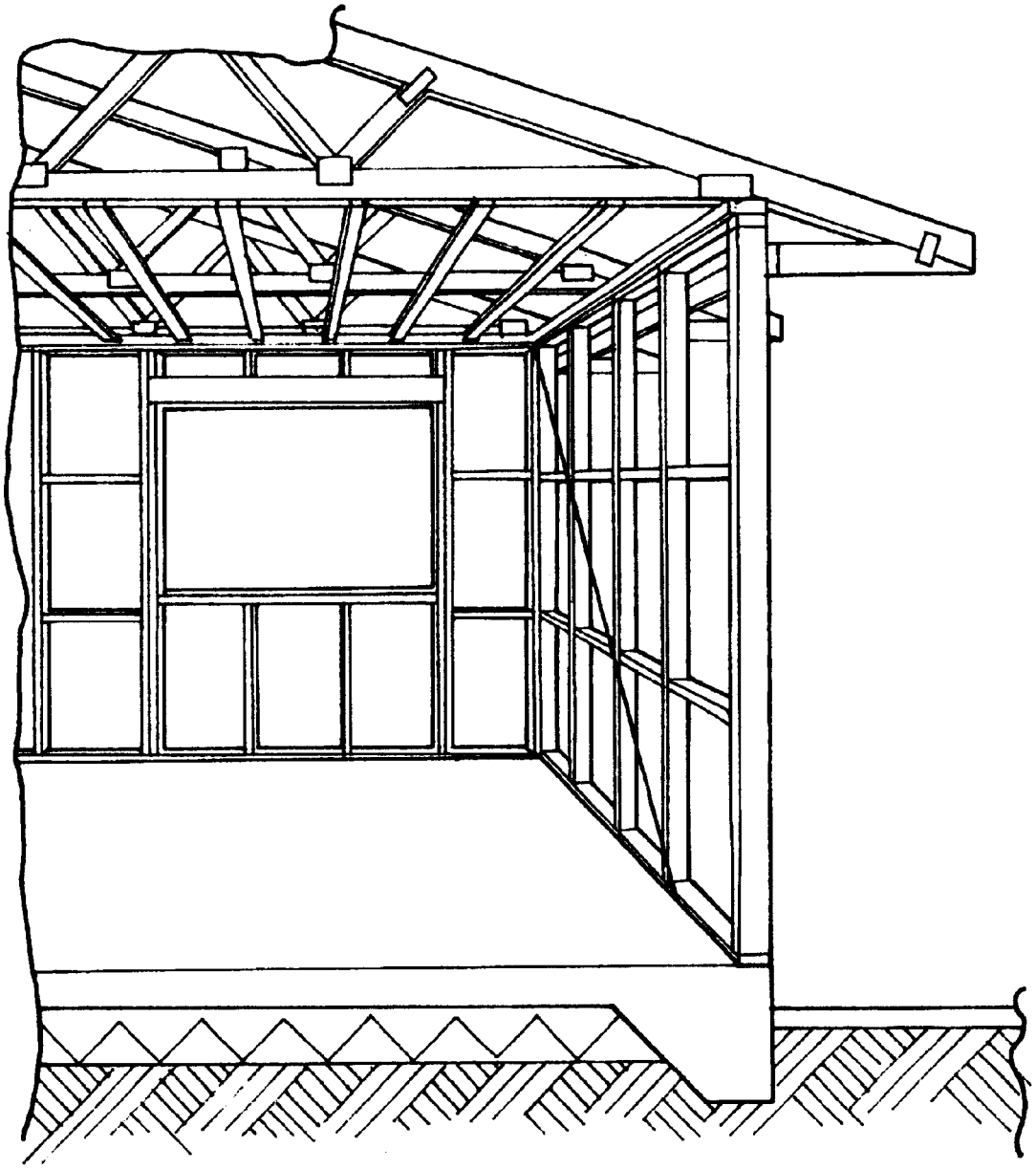
FIG. 3 (PRIOR ART)
FIG. 3 illustrates a prior art truss arrangement.
Figure 4:
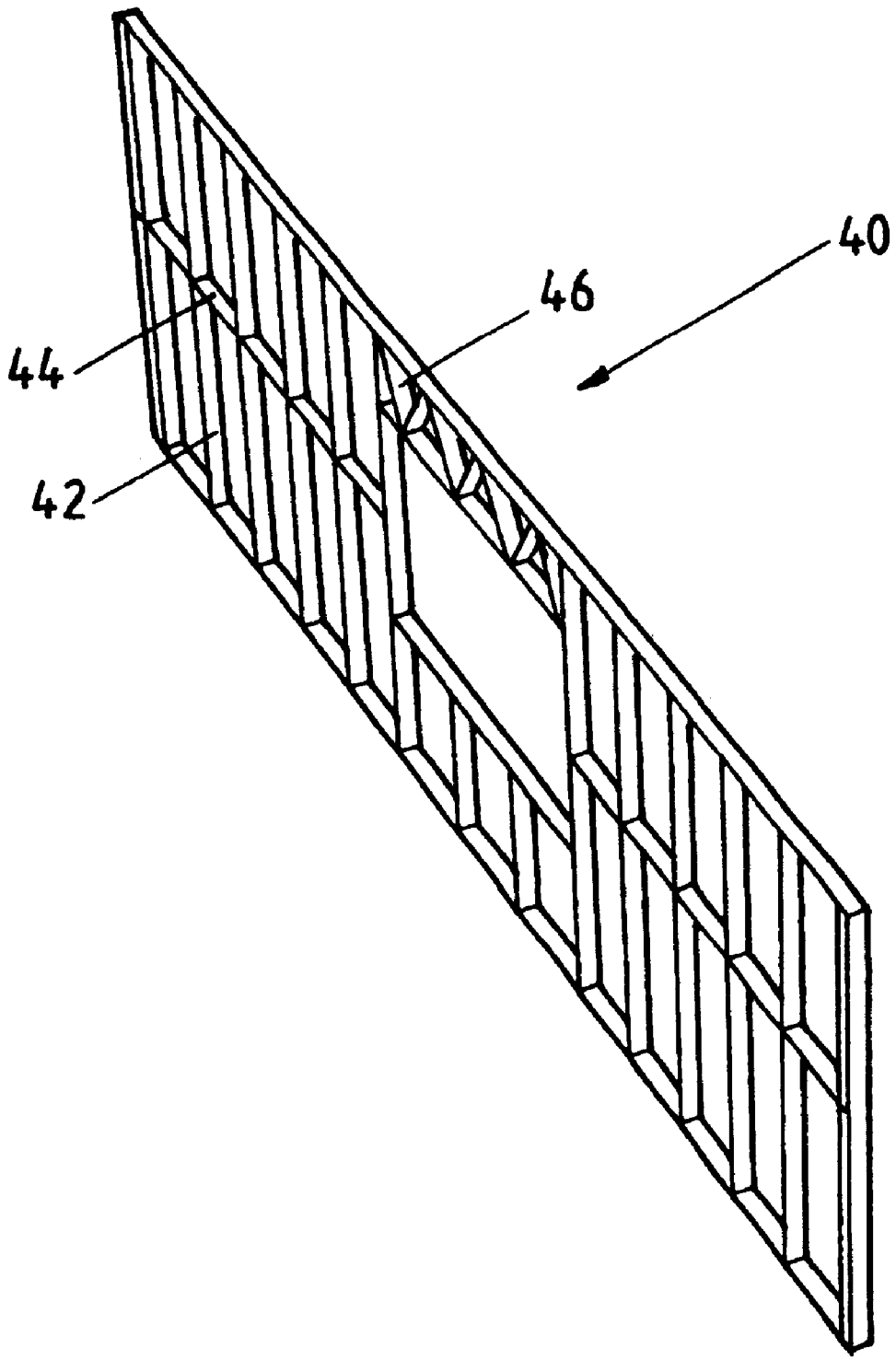
FIG. 4 is a perspective view of a wall frame constructed using the structural member illustrated in FIG. 1*a;*

Another type of junction is illustrated in 2*b*. Whereas the junction illustrated in 2*c* is of the type where one structural 25 can be inserted into the channel of the other structural member 26, the junction illustrated in FIG. 2*b* is of an alternative type whereby the member extending through the intersection has the open side of the channel facing away from the other member. A notch 17 is created in structural member 20 in order to receive the structural member 21. The structural member 20 also has flattened edge portions 15 in the vicinity of the junction to facilitate the insertion of structural member 21 within the notch 17 of structural member 20.

The joints between intersecting structural members are secured by rivets and for this purpose aligned holes 16 are punched or drilled through the structural members 10, 25, 26, 20, 21. Additionally service holes (not shown) may be provided in the structural members to accommodate electrical wiring or other utilities.

It is intended that all of the structural members will be produced by an automated roll forming machine. The machine is described in more detail in New Zealand Patent Application No. 332,446, the details of which are incorporated herein by reference. The automated roll forming machine is provided with a plan of the frame which it is required to produce, including the positioning of each of the structural members making up the frame. See for example, the wall frame 40 in FIG. 4. The wall frame 40 is comprised of upright studs 42 between which horizontal dwangs 44 extend. As the majority of the wall frames 40 will be load-bearing the window illustrated has been provided with a structural lintel 46 comprising diagonally extending structural members arranged in adjacent V-formations.

The automated roll forming machine (not shown) will receive information as to the location of each structural member making up a particular frame. The roll forming machine includes a processor such as a computer which calculates the length of each structural member to enable the wall frame 40 to be assembled as designed. Additionally, the processor calculates the placement of the holes 16, service holes, the flattened edge portions 15 and the notches 17.

This information is used to produce the structural members on the roll forming machine. The use of light gauge steel means the structural members can be easily formed and cut (by guillotine action) as required. The roll forming machine is computer controlled and the machine will therefore produce the structural members precisely according to the specifications determined by the processor. In view of the fact that the structural members are produced according to specification, the structural members can be assembled immediately without any subsequent forming operations.

Ideally, the processor instructs the roll forming machine to produce the structural members in the most convenient order for assembly. In connection with FIG. 4, the roll forming machine may produce the external structural members first, followed by the upright studs 42 from one end of the frame 40 to the other, the studs being interspersed by the dwangs 44. In this manner, the frame 40 may be assembled immediately the structural members are produced from the roll forming machine. This facilitates assembly of the frame 40 and reduces the potential for losing or confusing pieces of the frame.

Further, as the structural members have been produced with light gauge steel section, the junctions between the structural members may be achieved by simply inserting one structural member within the other. The use of light gauge steels allow a degree of deformation of either or both of the members to allow one to be accommodated within the other. Furthermore, as the notch, flattened portion and rivet hole positions have been accurately calculated, the structural members can be simply fitted and rivetted together without the need for special framing jigs to hold the structural members in position while holes are drilled. The frames may be assembled with the use of simple freestanding rests which are movable as required to a convenient location to hold the structural members at a convenient height above the ground to enable rivetting of the frame together. Because the frames are so light, once assembled by a worker at ground level, they can be manually lifted into position and secured to the slab or each other as required.

Figure 5:
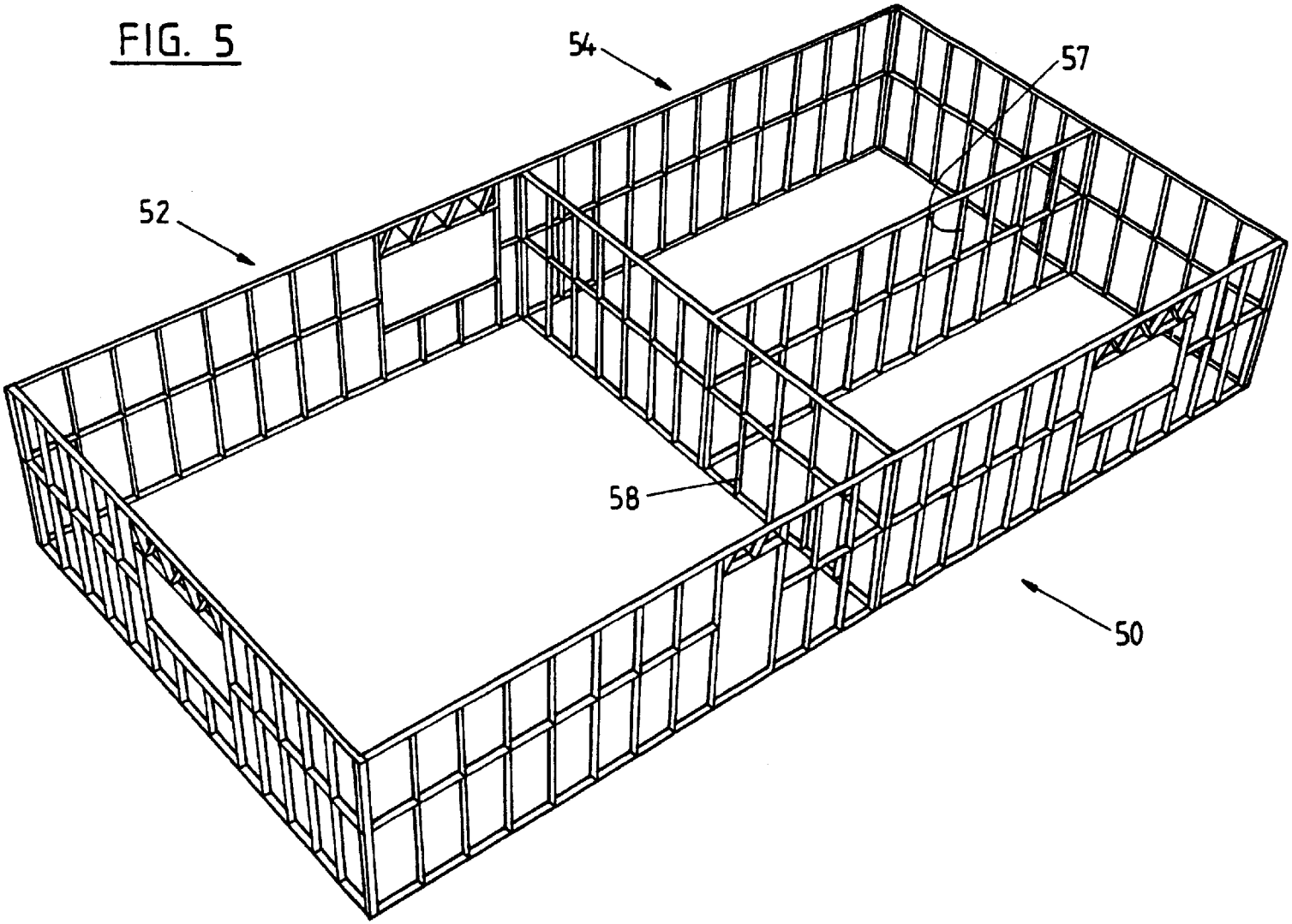
FIG. 5 is a perspective view of a building illustrating the internal and external wall frames in position.

FIG. 5 illustrates the external and internal walls of a building 50. The walls have been constructed on a slab (not shown), the construction of which will be described subsequently in further detail. Each of the external walls has not been produced as single units but as separate frames for example 52, 54 which are assembled side by side. The extent of the wall frames 52, 54 is a matter of convenience since large frames become unwieldy.

Figure 6:
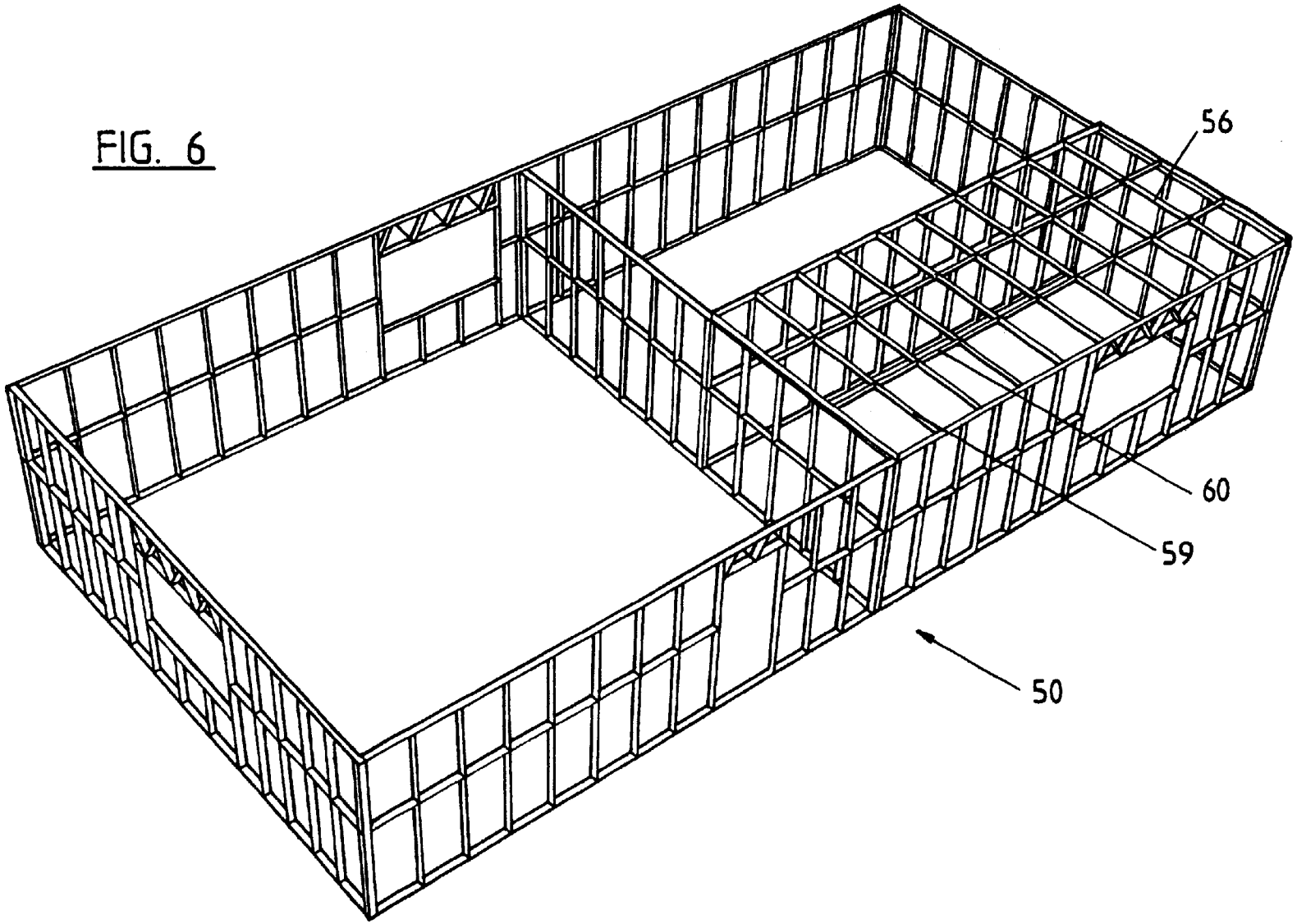
FIG. 6 is a perspective view of a building illustrating the internal and external wall frames in position together with a ceiling frame.
Figure 7:
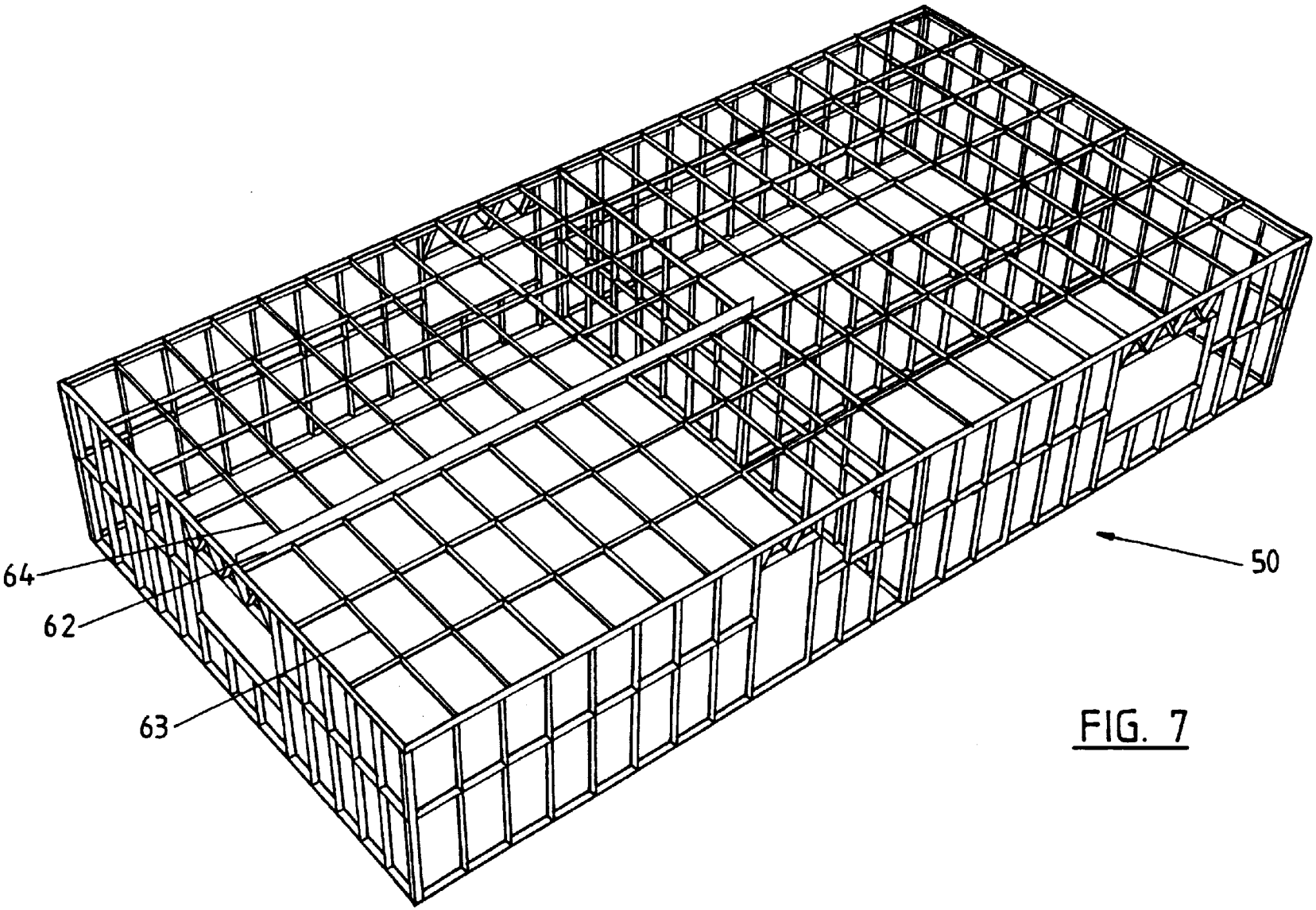
FIG. 7 is a perspective view of the building illustrating all of the ceiling frames in position.

FIG. 6 illustrates the building 50 with one ceiling frame 56 assembled in position. It will be appreciated that due to the size of the building 50, at least four ceiling frames 56 will be required. The ceiling frame 56 is supported by the external walls as well as the internal walls 57, 58, which are depicted more clearly in FIG. 5. The ceiling frame 56 comprises long structural members 59 with transverse nogs extending between adjacent long structural members 59. The structural members 59 may be made up of two steel sections (as depicted in FIG. 1*a*) placed back to back to provide additional strength, particularly for a worker to walk on the ceiling frames during construction. FIG. 7 illustrates the building 50 with each of the ceiling frames in position. Additionally, a steel web 62 has been installed to extend across a large unsupported expanse of the building 50. The web 62 is steel sheet which is approximately 300 mm in breadth. The web 62 is inserted between the two structural members which lie back to back between adjacent ceiling frames 63, 64.

Figure 8:
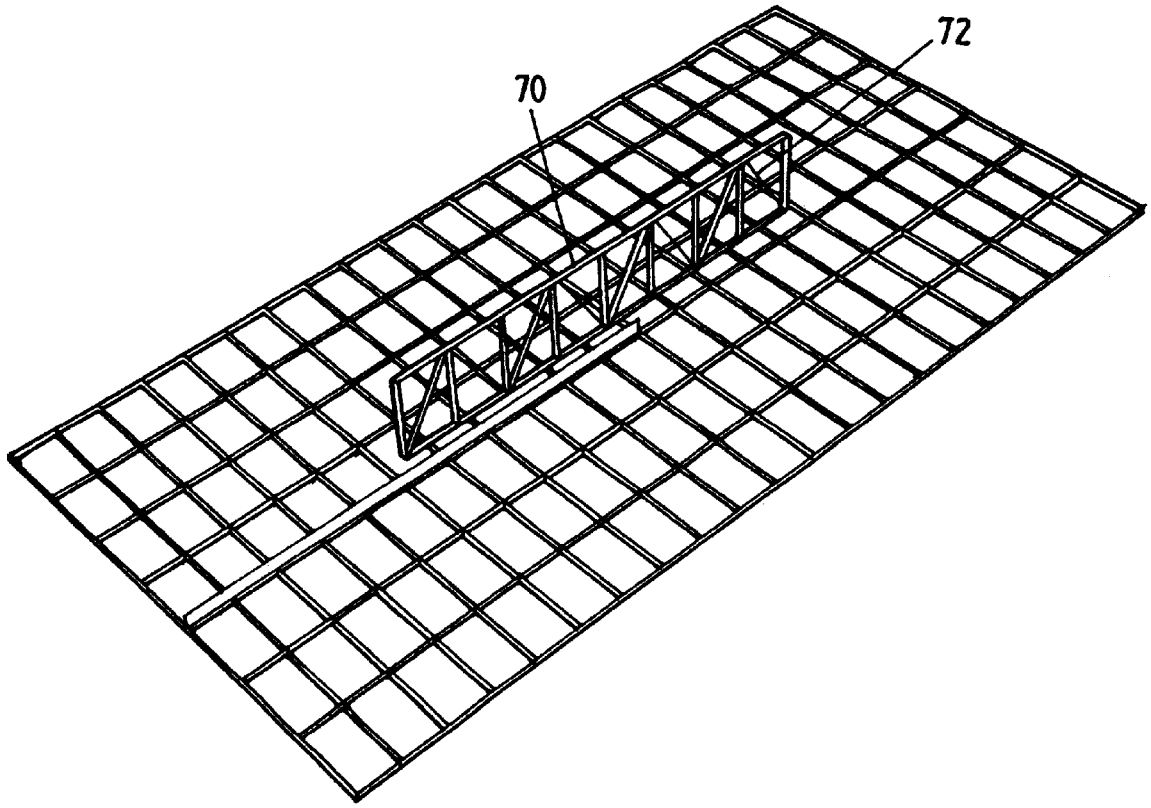
FIG. 8 is a perspective view of the ceiling frame and a ridge frame.
Figure 9:
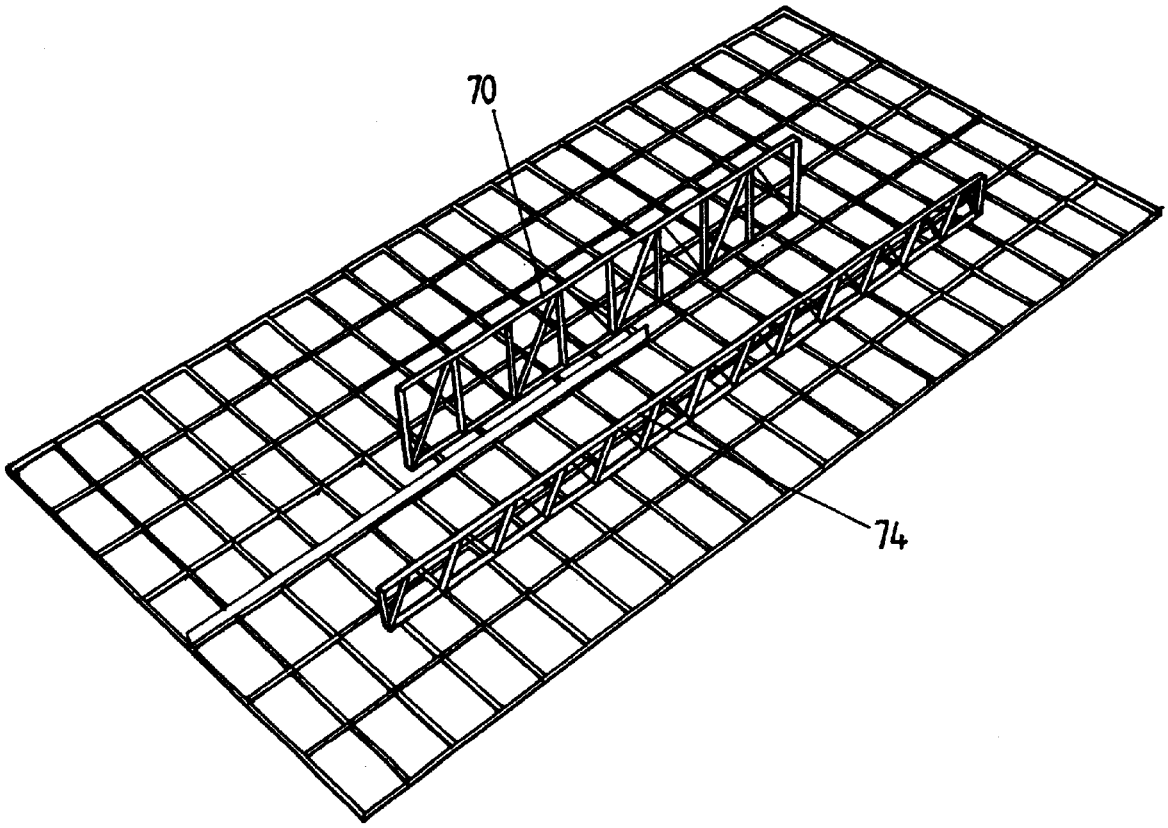
FIG. 9 is a perspective view of the ceiling frame, a ridge frame and an intermediate support frame.

FIG. 8 illustrates the ceiling frames, with the wall frames removed for clarity. The construction of the building slab will now be described since the slab is constructed with the aid of the assembled ceiling frames. Ideally, the structural members forming the ceiling frames are the first members produced by the roll forming machine and the ceiling frames are the first frames of the building assembled. Once the ceiling frames have been assembled they may be temporarily joined or merely placed in their relative disposition to one another on the ground in the intended location of the building. The external periphery of the ceiling frames will define an exact footprint for the slab. As an initial step, the external periphery of the ceiling frames is marked on the ground. This may be achieved by the use of a spray can. Then, the ceiling frames are removed and the footings are dug which are filled with concrete in the normal manner. Steel reinforcing for the slab is also positioned in the normal manner. Once the steel reinforcing has been positioned, the ceiling frames are returned to their initial position on the ground. The ceiling frames thereby define a guide about which the formwork can be constructed facilitating accurate positioning of the formwork and thus accurate sizing of the slab. Following assembly of the formwork, the ceiling frames are removed and the slab is poured within the formwork in the normal manner.

Returning to FIG. 8, the ceiling frames are illustrated with a central planar upright ridge frame 70 illustrated in position on the ceiling frames. The ridge frame 70 is located to lie underneath the ridge formed in the completed roof structure as can be more clearly seen in FIG. 11. The ridge frame extends in the lengthwise direction of the roof structure and includes diagonal braces 72 as can be seen in FIG. 8. If the width of the building 50 requires it, intermediate upright planar support frames 74 may also be provided. These extend parallel to the central ridge frame 70, in the lengthwise direction of the building 50. The intermediate support frames 74 also include diagonal bracing.

Figure 10:
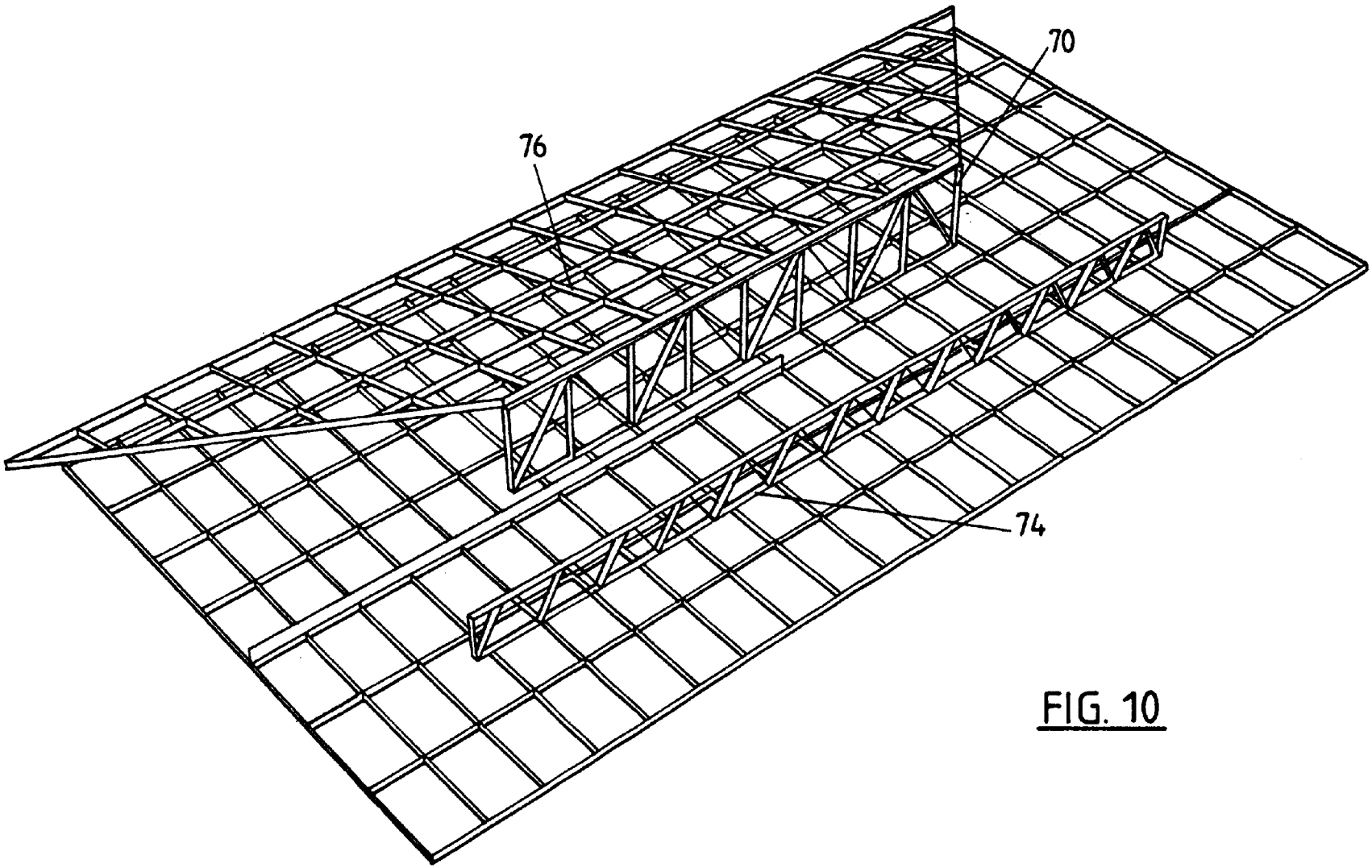
FIG. 10 is a perspective view of the roof structure with one inclined roof frame in position.

FIG. 10 illustrates one of the planar roof frames 76 in its inclined position. The roof frame 76 is supported by the central ridge frame 70. An intermediate support frame 74 may also be provided to support the roof frame 76 but this is removed from the drawing for improved clarity. It can be seen that the roof frame 76 comprises longitudinal and transverse structural members. In the finished roof, the roof frame 76 will support the roofing material of an entire inclined surface of the roof and the roof frame 76 thereby extends parallel to the intended roof surface. In fact, the entire roof frame 76 is constructed on-site and lifted into position as a single unit. Further, use of thin gauge steel section means that the roof frame 76 is so light it can be manually lifted into position. The roof frame 76 as with the other frames illustrated so far, is constructed by positioning a number of moveable free-standing supports into appropriate positions to receive the main structural members of each frame eg the outer structural members. Once the outer structural members have been supported and joined, the internal structural members can be rivetted into position. Ideally, the whole frame is assembled parallel to the ground at about 1 to 1.5 metres above the ground. This provides a comfortable height for the workers assembling the frame and also enables the workers to move under the frame to rivet the internal joints where required.

Figure 11:
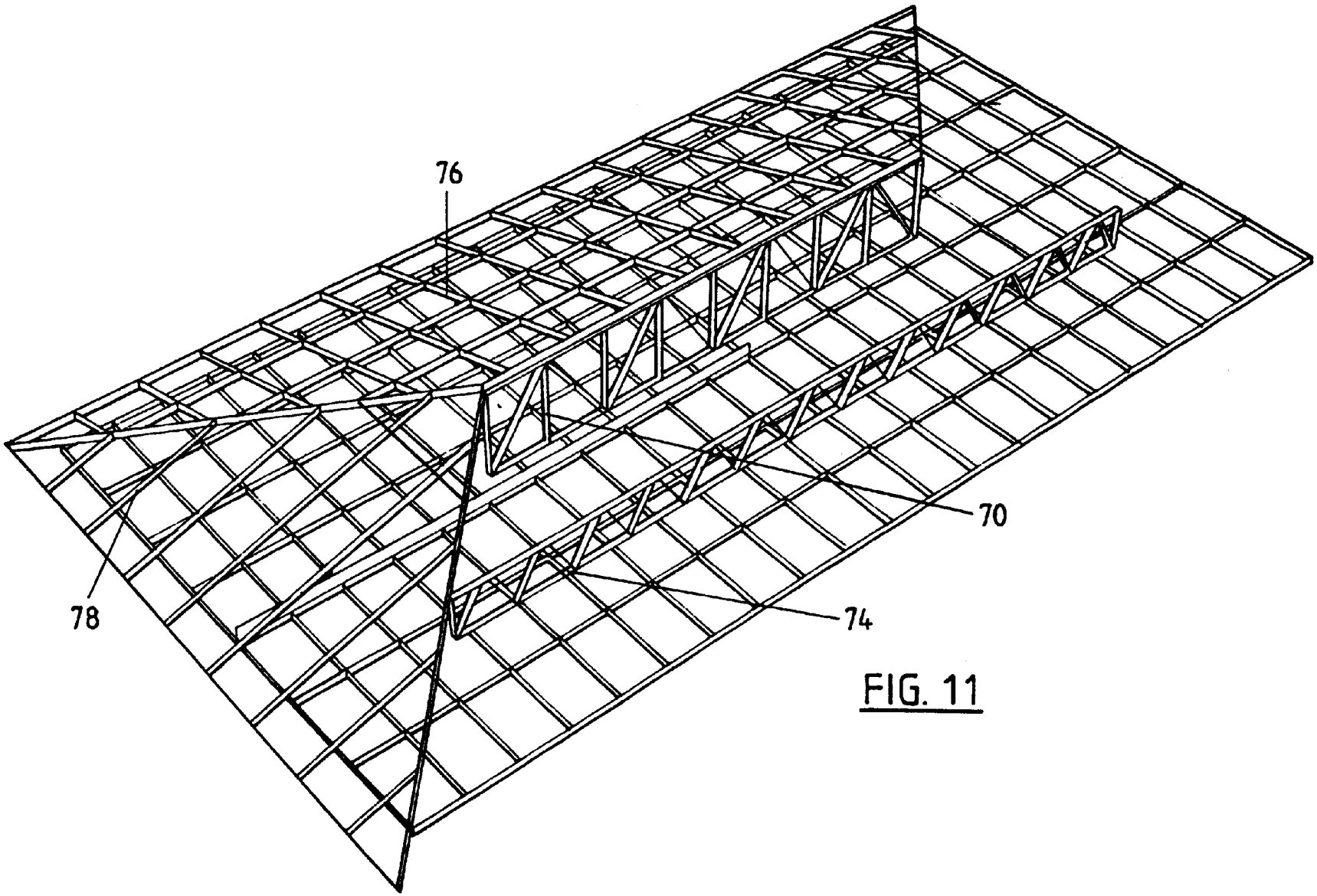
FIG. 11 is a perspective view of the roof structure illustrated in FIG. 10 together with a hip frame in position.

FIG. 11 illustrates a hip frame 78 in position. The hip frame 78 is assembled in like manner to the roof frame 76 although the hip frame 78 is supported at its apex by the end of the ridge frame 70 and at intermediate locations along its side edges by the intermediate frame 74. The hip frame 78 may also be supported at its side edges by the adjacent edges of the adjacent roof frame 76. It will also be appreciated that each of the roof and hip frames 76, 78 are supported at their lower edges by the outer edge of the ceiling frames referred to as the top plate.

Once the building frame has been assembled, construction of the building can proceed in a conventional manner. Exterior cladding and roofing materials may be attached to the framework. Interior cladding such as plasterboard may also be installed.

The foregoing describes only one embodiment of the invention and modifications may be made thereto by those skilled in the art without departing from the scope of the present invention.

What is claimed is:

1. A method of constructing a roof structure for a building, the roof structure being of the type intended to support two or more inclined roof surfaces, the method including:

moving pre-assembled planar roof frames into respective inclined positions, each roof frame being moved to a position lying substantially parallel to the plane of an associated intended roof surface to thereby support the associated roof surface; and supporting each of the roof frames in its inclined position by a support which includes a central upright planar frame underneath the intersection of two inclined roof surfaces.

2. The method as claimed in claim 1 wherein a single inclined roof frame is provided to support each inclined roof surface, each of the roof frames being moved into position as a single unit.

3. The method as claimed in claim 1 wherein each roof frame is assembled on site prior to moving into position.

4. The method as claimed in claim 1 further including the steps of: assembling each roof frame from light-weight steel structural members by workers operating at ground level; and lifting each roof frame manually into position.

5. The method as claimed in claim 1 wherein each roof frame comprises a number of structural members, the method further including:

constructing all of the frames from structural members of the same steel section, the same steel section being used for the whole of each frame; and assembling all of the structural members of each frame to lie in the same plane.

6. The method as claimed in claim 1 wherein at least one of the roof frames associated with a corresponding inclined roof surface is also supported by an intermediate planar support frame extending parallel to the central planar frame.

7. The method as claimed in claim 1 wherein the inclined roof surfaces meet at a ridge and the central planar frame extends substantially along the length of the ridge.

8. The method as claimed in claim 1 wherein the support means and the outer edges of the inclined roof frames are supported by a planar ceiling structure extending substantially the length and breadth of the building.

9. The method as claimed in claim 8 wherein the planar ceiling structure is assembled from a number of pre-assembled planar ceiling frames lifted into position.

10. The method as claimed in claim 1 wherein the roof structure is of the type intended to support one or more inclined hip surfaces, the method further including:

lifting one or more pre-assembled hip roof frames into position lying substantially parallel to the plane of an associated intended hip surface to thereby support the associated hip surfaces in the finished roof; and supporting the one or more hip roof frames from adjacent edges of the adjacent inclined roof frames.

11. A steel frame building construction including:

external wall frames and internal wall frames;

one or more substantially planar ceiling frames supported by the external wall frames and the internal wall frames;

a roof structure including one or more inclined substantially planar roof frames extending substantially parallel to associated roof surfaces which the roof frames support; and support means extending between the one or more roof frames and the one or more ceiling frames to transfer the weight of the roof structure to the one or more ceiling frames to thereby distribute the combined weight of the roof structure and the one or more ceiling frames and the support means through the external and internal walls frames, wherein each of the wall frames, the one or more ceiling frames and the one or more roof frames are constructed of steel structural members.

12. The building construction as claimed in claim 11 wherein the steel structural members are formed from steel sheet of approximately 0.55 mm in thickness.

13. The building construction as claimed in claim 11 wherein all of the structural members of all of the frames are of the same steel section.

14. The building construction as claimed in claim 11 wherein for each frame, all of the steel structural members lie in the same plane thereby defining a number of junctions within the plane with one structural member received within another structural member.

15. The building construction as claimed in claim 14 wherein the structural members each have a web and two arms completing a channel section, with inward strengthening folds at the outer edge of each arm, the other structural member at each junction having its strengthening folds being formed back to at least the plane of the associated arm in the region of the junctions.

16. The building construction as claimed in claim 11 wherein the ceiling frames have long and short transverse structural members, the long members being arranged in a series of spaced back-to-back pairs, the short transverse structural members being inserted between the spaced pairs of long structural members.

17. The building construction as claimed in claim 11 wherein the roof structure has two inclined roof surfaces meeting at a ridge which extends in the lengthwise direction of the roof structure, the two inclined roof surfaces each being supported by one or more inclined planar roof frames, the roof frames being supported by the support means which includes a central planar upright support frame disposed underneath the ridge.

18. The building construction as claimed in claim 12 wherein the support means includes three upright planar support frames extending in the lengthwise direction of the roof structure.

19. The building construction as claimed in claim 17 wherein the upright planar support frame includes diagonal braces.

20. The building construction as claimed in claim 17 wherein the central upright support frame extends substantially the length of the ridge.

21. A building construction comprising wall frames, a roof structure having a number of frames, and a roof support structure having a number of frames, the roof support structure supporting the roof structure on the wall frames, each of the wall frames and frames for the roof structure and roof support structure consisting of elongated structural load bearing members which are connected together at joint connections, each structural member having an elongated section disposed adjacent to a joint connection, each section having substantially the same transverse cross sectional configuration for each structural member.

22. The building construction as claimed in claim 21 wherein the elongate structural members are formed from sheet steel of approximately 0.55 mm in thickness.

23. The building construction as claimed in claim 21 wherein the elongate structural members of each frame lie in the same plane thereby defining a number of junctions within the plane with one elongate structural member received within another elongate structural member, each of the elongate structural members having a web and two arms completing a U-section, with inward strengthening folds at the outer edge of each arm, at each junctions, the other elongate structural member having its strengthening folds being formed back to at least the plane of the associated arm in the region of the junction.

24. A method of constructing the building components for a building including:

constructing wall frames;

constructing a roof support structure from a number of frames;

constructing a roof structure from a number of frames; and each of the frames being constructed by interconnecting a plurality of structural load bearing members which are designed to withstand a design load, the structural load bearing members being elongate structural members wherein the elongate structural members are substantially of the same steel section for the whole of each frame and for all of the frames.

25. The method as claimed in claim 24 wherein the method further includes assembling all of the structural members in the same plane to thereby define a number of junctions and the junctions, fitting the structural member together with one structural member received within another structural member.

26. The method as claimed in claim 25 wherein the structural members each have a web and two arms completing a U-section, with inward strengthening folds at the outer edge of each arm, the method further including, for each junction, forming back the strengthening folds on the other structural member to at least the plane of the associated arm in the region of the junctions.

27. A structural frame comprised of a number of intersecting structural members of the same cross-section wherein the structural members each have a web and two arms completing a U-section, with inward strengthening folds at the outer edge of each arm, one structural member being fitted within another structural member at the intersections to form junctions, at each junction, the other structural member having its strengthening folds being formed back to at least the plane of the associated arm in the region of the junctions.

28. A method of constructing a structural frame from a number of structural members of the same cross-section wherein the structural members each have a web and two arms completing a U-section, with inward strengthening folds at the outer edge of each arm, the method further including fitting the structural members together to define a number of intersections therebetween, with the intersections having one structural member fitted within another structural member to form junctions, the method including, at each junction, forming back the strengthening folds on the other structural member to at least the plane of the associated arm, in the region of the junction.

29. A method of constructing a roof structure for a building, the method comprising:

positioning a substantially planar ridge frame on top of a building frame such that that the ridge frame is substantially vertically disposed, the ridge frame having a longitudinally extending top edge;

securing a pre-assembled, substantially planar first roof frame such that the first roof frame extends at an inclination from the ridge frame to the building frame, the first roof frame having an edge longitudinally extending along at least a portion of the top edge of the ridge frame; and securing a pre-assembled, substantially planar second roof frame such that the second roof frame extends at an inclination from the ridge frame to the building frame, the second roof frame being on a side of the ridge frame opposite the first roof frame, the second roof frame having an edge longitudinally extending along at least a portion of the top edge of the ridge frame.

30. A method as recited in claim 29, wherein the positioning and securing acts comprise the ridge frame, the first roof frame, and the second roof frame, each being comprised of elongated structural members having a substantially U-shaped transverse cross section.

31. A steel frame building construction comprising:

wall frames;

one or more substantially planar ceiling frames supported by the wall frames;

a roof structure including one or more inclined substantially planar roof frames; and one or more substantially planar support frames substantially vertically extending between the one or more roof frames and the one or more ceiling frames, wherein each of the one or more ceiling frames, the one or more roof frames, and the one or more support frames are constructed of steel structural members.

32. A steel frame building construction as recited in claim 31 wherein the wall frames comprise external wall frames.

33. A steel frame building construction as recited in claim 31 wherein the steel structural members have a substantially squared U-shaped transverse cross section.

* * * * *

UNITED STATES PATENT AND TRADEMARK OFFICE

CERTIFICATE OF CORRECTION

PATENT NO. : 6,253,521 B1
DATED : July 3, 2001
INVENTOR(S) : Peter Geoffrey Gavin, Peter Robert Brennan and Thomas William Ellis It is certified that error appears in the above-identified patent and that said Letters Patent is hereby corrected as shown below:

Column 9,
Line 53, before "and the outer edges" delete [means]

Signed and Sealed this

Fourteenth Day of May, 2002

*Attest:*

*Attesting Officer*

JAMES E. ROGAN
*Director of the United States Patent and Trademark Office*